US006426688B1

(12) United States Patent
DeVizzi et al.

(10) Patent No.: US 6,426,688 B1
(45) Date of Patent: Jul. 30, 2002

(54) MODULAR CONTACT SYSTEM FOR DIFFERENT FRAME SIZES

(75) Inventors: Francesco DeVizzi, Milan (IT); Stefan Kranz, Eutin (DE)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/318,357

(22) Filed: May 25, 1999

(51) Int. Cl.[7] ..... H01H 75/00; H01H 77/00; H01H 83/00

(52) U.S. Cl. ..... 335/16; 218/22; 335/147; 335/195; 335/202

(58) Field of Search ..... 335/6, 16, 8–10, 335/147, 195, 202; 218/153–5; 200/283–8

(56) References Cited

U.S. PATENT DOCUMENTS 2,601,417 A * 6/1952 Scott, Jr. ..... 335/16
4,884,047 A * 11/1989 Baginski et al. ..... 335/10
4,945,326 A * 7/1990 Kandatsu ..... 335/16
5,004,878 A * 4/1991 Seymour et al. ..... 218/154
5,073,764 A * 12/1991 Takahashi et al. ..... 335/16
5,172,087 A * 12/1992 Castonguay et al. ..... 335/160
5,310,971 A * 5/1994 Vial et al. ..... 218/22
5,351,024 A * 9/1994 Juds et al. ..... 335/16
5,357,066 A * 10/1994 Morel et al. ..... 218/22
5,424,701 A * 6/1995 Castonguay et al. ..... 335/172

* cited by examiner

*Primary Examiner*—Lincoln Donovan
(74) *Attorney, Agent, or Firm*—David Arnold; Karl A. Vick

(57) ABSTRACT

A circuit breaker rotary contact arm is used within a plurality of single pole modules ganged together to form a single multi-pole circuit breaker. To provide for use in quiescent conditions having high ampere ratings, low ampere rated rotary contact arm assemblies are combined in parallel to form a higher rated single pole module, which are then ganged together to form a single multi-pole circuit breaker having a high quiescent ampere rating.

1 Claim, 5 Drawing Sheets

MODULAR CONTACT SYSTEM FOR DIFFERENT FRAME SIZES

BACKGROUND OF THE INVENTION

1. Field of Invention

The present invention relates in general to an electrical circuit breaker provided with a modular contact system. More particularly, the present invention relates to a modular contact system made up of a multiplicity of single pole breaking modules having many different sizes, through simple parallel connection of individual single pole modules.

2. Description of Related Art

Multi-pole circuit breakers comprising a modular array of single-pole circuit breakers connected together by means of fasteners are well known in residential applications. U.S. Pat. No. 5,172,087 entitled "Handle Connector for Multi-Pole Circuit Breaker" describes such a multi-pole circuit breaker that incorporates an improved operating handle to integrate the separate single pole-handles into one effective operating handle. The overall width of the multi-pole circuit breaker is the sum of the individual single pole circuit breaker widths.

U.S. Pat. No. 6,326,868 entitled "Rotary Contact Assembly for High Ampere-Rated Circuit Breakers," herein incorporated by reference, describes single pole rotary contact arm assemblies ganged together to form a multi-pole circuit breaker. Interconnection of the contact arm assemblies with the operating mechanism is achieved by means of an elongated pin, thereby enabling a single mechanism to operate all single pole rotary contact arm assemblies. The rotary arrangement of the contact arms produces two arcs in series during a short circuit interruption, which rapidly and effectively extinguishes the short circuit current to disconnect the protected circuit.

For circuit breaker applications requiring high quiescent ampere ratings, the use of a larger circuit breaker with proportionately larger single pole components is well known and is described in U.S. Pat. No. 5,424,701 entitled "Operating Mechanism for High Ampere-Rated Circuit Breakers." Another method of serving high quiescent ampere rated applications without increasing the size of the single pole components is by adjoining two standard sized circuit breakers and connecting adjacent poles in parallel. Such a twinned arrangement is described in U.S. Pat. No. 4,884,047 entitled "High Rating Multi-pole Circuit Breaker Formed by Two Adjoined Molded Cases." The overall width of the twinned multi-pole circuit breaker is the sum of the individual multi-pole circuit breaker widths.

SUMMARY OF THE INVENTION

Multiple rotary contact arm assemblies having a low quiescent ampere rating are connected in parallel to form a single pole circuit breaker module having a high quiescent ampere rating, higher than the rating of its individual components. Ganging together these single pole circuit breaker modules, which comprise standard parts and modular assemblies, forms an economical and compact multi-pole circuit breaker having a high quiescent ampere rating.

The invention offers advantages of both a rotary contact arm assembly and a modular construction. The rotary contact arm configuration, which produces two arcs in series, provides an effective means for rapidly suppressing and extinguishing short circuit currents, and the single pole module, with parallel connected low ampere rated contact arms, provides an economical and compact means of achieving a high ampere rating.

According to the invention, a circuit breaker, comprising a circuit breaker housing and a first and second current path housing arranged within the circuit breaker housing. A first current path is arranged within the first current path housing and is connected to the protected circuit. A second current path is arranged within the second current path housing and is electrically connected in parallel to the first current path and is also connected to the protected circuit. An operating mechanism is arranged within the circuit breaker housing for disconnecting the protected circuit upon occurrence of an overcurrent condition in the protected circuit. A trip unit is arranged within the circuit breaker housing for articulating the operating mechanism upon occurrence of the overcurrent condition.

DESCRIPTION OF PREFERRED EMBODIMENT

Figure 1:
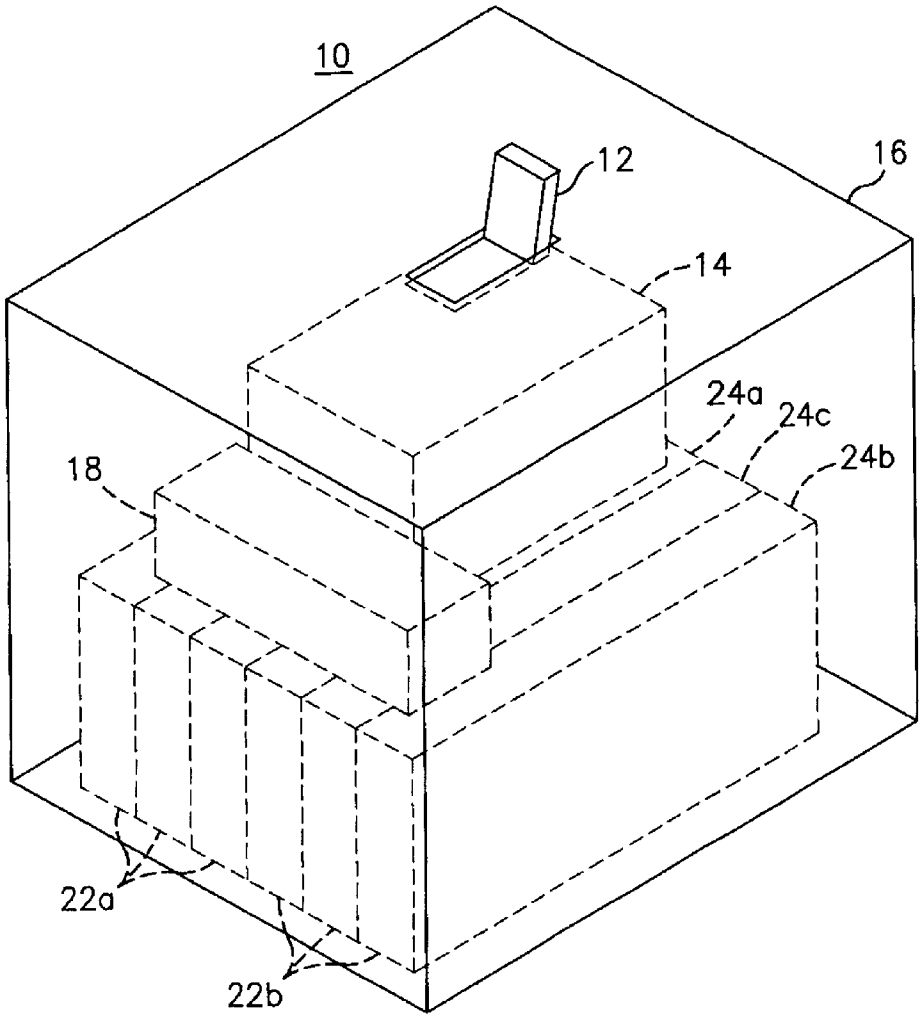
FIG. 1 is a perspective view of a high ampere rated multi-pole circuit breaker in accordance with the invention.
Figure 5:
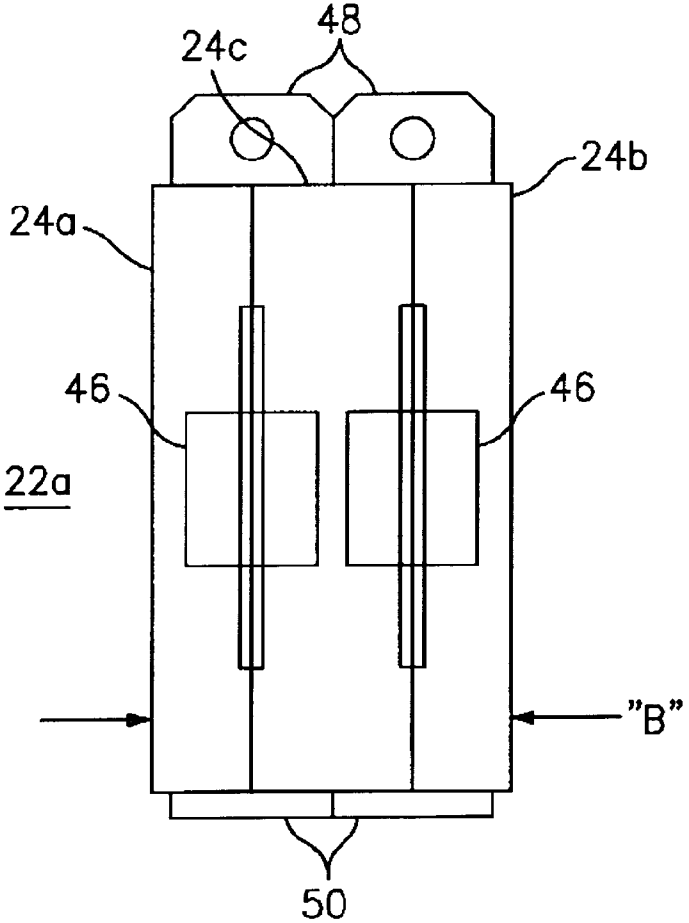
FIG. 5 is a top view of a high ampere rated single pole module showing two rotary contact arm assemblies arranged for parallel connection in accordance with the invention.

FIG. 1 depicts a multi-pole molded case circuit breaker 10 with operating handle 12 that interfaces with mechanism 14 contained within circuit breaker housing 16. The mechanism 14, actuated by trip unit 18 during an overcurrent condition, articulates contact arms 20 (shown in FIG. 3) within the single pole modules 22*a*, 22*b*. The single pole modules 22*a*, 22*b* comprise outer current path housing 24*a*, 24*b* and inner current path housing 24*c* which house first and second current paths as best seen in FIG. 3 and FIG. 5.

Figure 2:
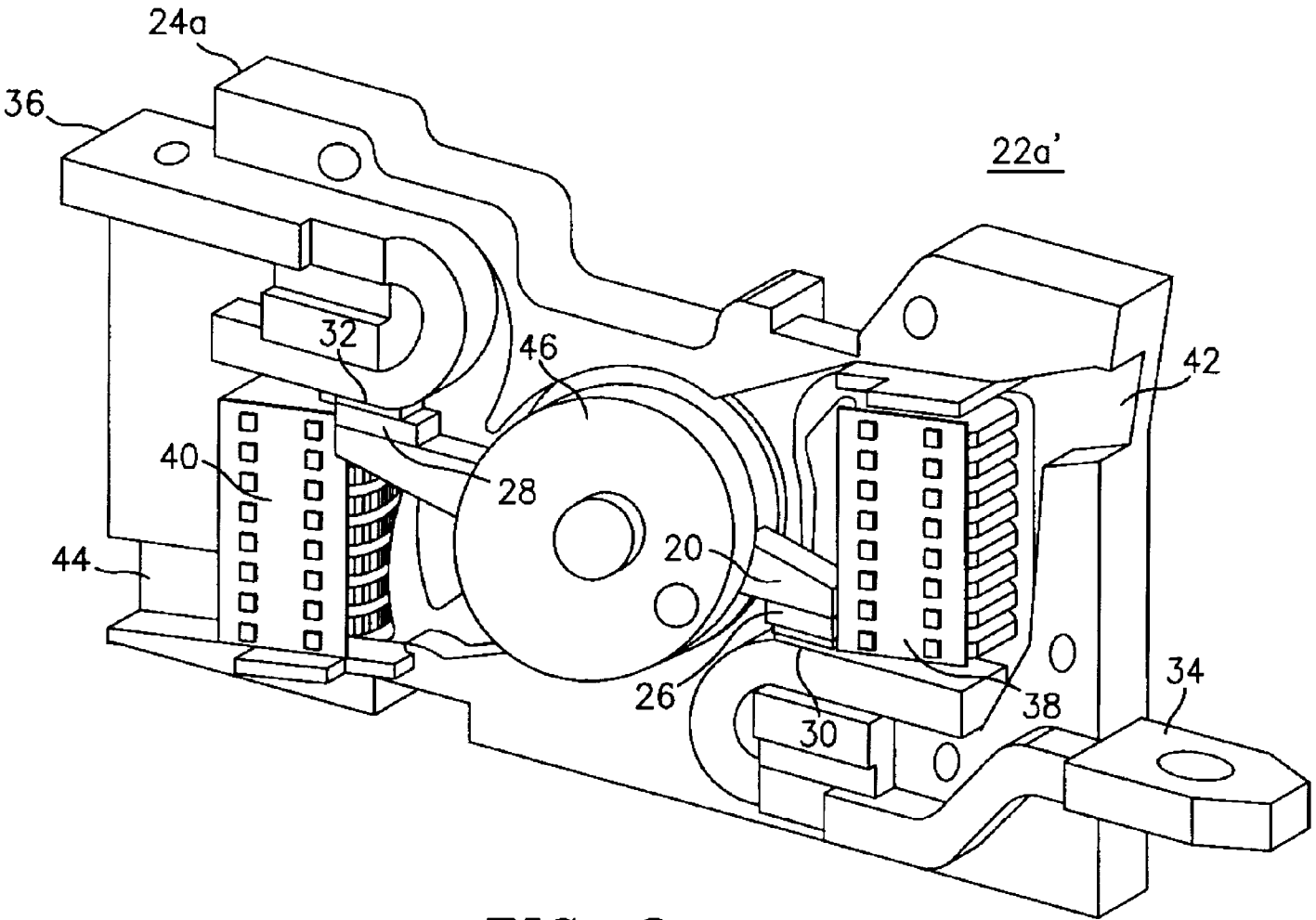
FIG. 2 is a perspective side view of a low ampere rated rotary contact arm single pole module with the cover removed to depict the circuit breaker components in the "On" condition.

FIG. 2 depicts a single pole module 22*a*' An outer current path housing 24*a* supports operating mechanism 14 to articulate the contact arm 20 between an open and closed position for isolation of a protected circuit. Movable contacts 26, 28 on contact arm 20 abut stationary contacts 30, 32 on line strap 34 and load strap 36. Under quiescent operating conditions, the electrical current passes through the line strap 34, stationary contact 30, movable contact 26, contact arm 20, movable contact 28, stationary contact 32, and load strap 18. The line strap 34 provides an electrical connection between the external power source and the circuit breaker internal components. A load terminal (not shown) provides means to electrically connect the protected circuit to the load strap 36.

The contact arm 20 is articulated during a short circuit overcurrent condition. This action produces an electrical arc (not shown) that is directed towards arc chutes 38, 40, with eventual extinguishing through exhaust ports 42, 44. The contact arm 20 and contact springs (not shown) are captivated by rotor assembly 46.

Figure 3:
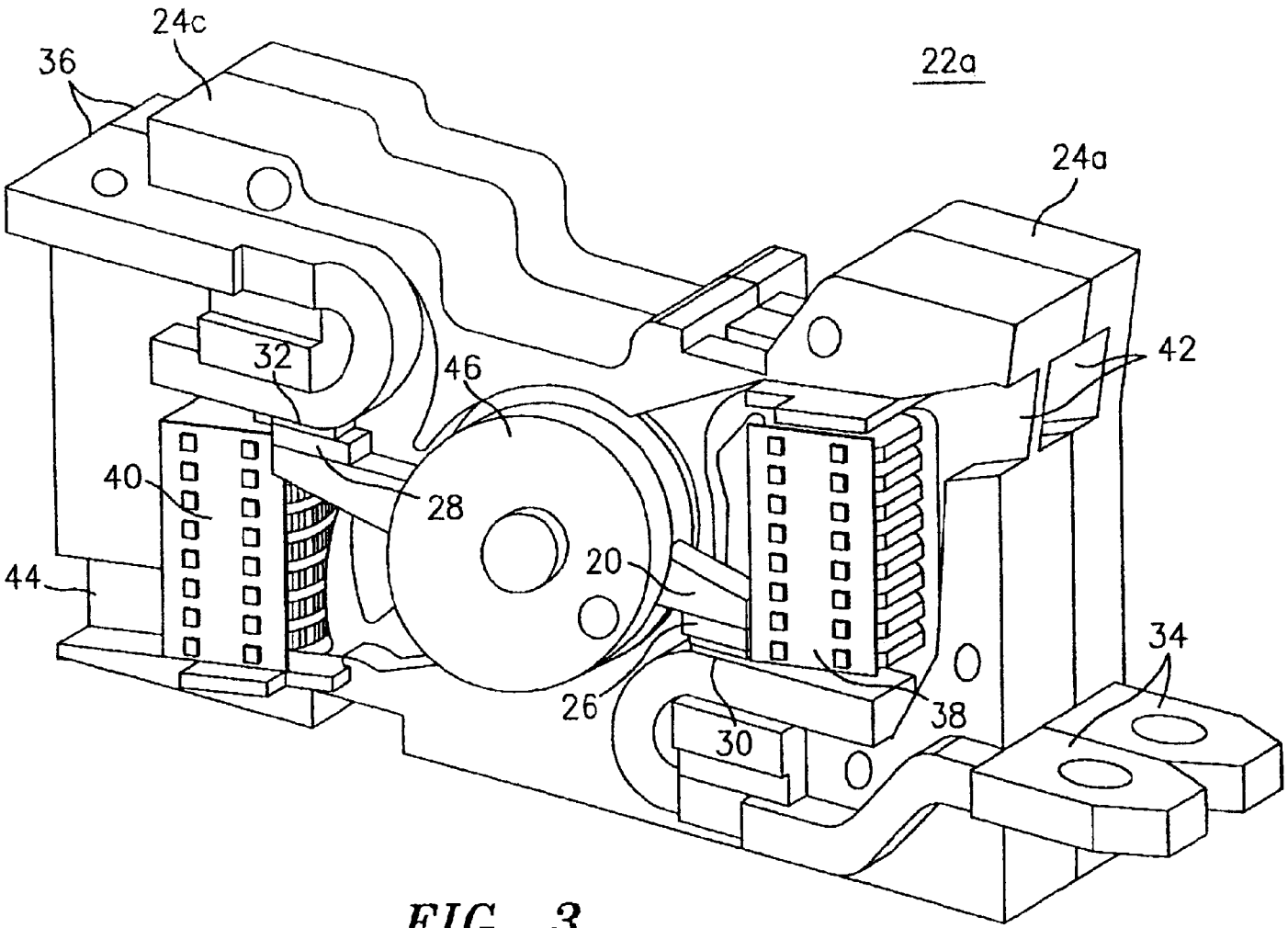
FIG. 3 is a perspective side view of a high ampere rated rotary contact arm single pole module with the cover removed to depict the circuit breaker components in the "On" condition, in accordance with the invention.

A higher rated single pole module 22*a* is shown in FIG. 3, wherein like reference numerals with respect to FIG. 1 and FIG. 2 designate corresponding parts. Two sets of internal components of the single pole molded case circuit breaker shown in FIG. 2. Each of the sets comprising, a line strap 34, a stationary contact 30, a movable contact 26, a rotary contact arm 20, a movable contact 28, a stationary contact 32, a load strap 36, arc chutes 38, 40, and rotor assembly 46. These sets are arranged adjacent each other and captivated by outer current path housing 24*a*, (24*b* removed for clarity) and inner current path housing 24*c*. This arrangement is best seen by now referring to FIGS. 4 and 5.

Figure 4:
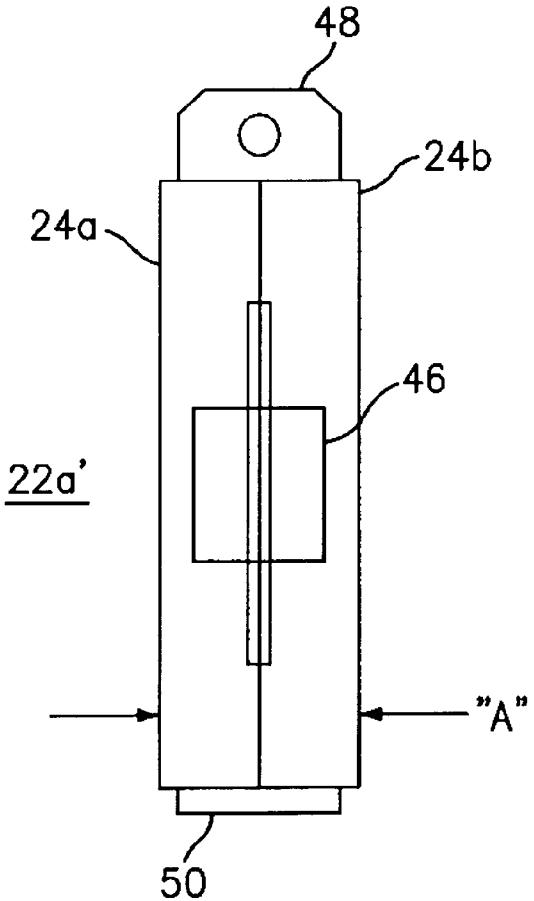
FIG. 4 is a top view of a low ampere rated single pole module showing only one rotary contact arm assembly.

FIG. 4 depicts a single pole module 22*a*', showing a single rotor assembly 46 captivated by outer current path housings 24*a*, 24*b* which is capable of carrying low quiescent electrical currents.

FIG. 5 depicts a higher rated single pole module 22*a*, showing two rotor assemblies 46 captivated by outer current path housings 24*a*, 24*b* and inner current path housing 24*c* which is capable of carrying higher quiescent electrical currents than that of FIG. 4. Outer current path housings 24*a*, 24*b* and inner current path housing 24*c* are restrained by fasteners (not shown). The parallel electrical connection to the aforementioned adjacent internal components are made at the external connection points 48, 50 of line strap 34 and load strap 36. The combined width of inner and outer current path housings (24*a*+24*b*+24*c*) is arranged to be less than (2) times (24*a*+24*b*), thereby resulting in dimension "B" being less than (2) times dimension "A".

Figure 7:
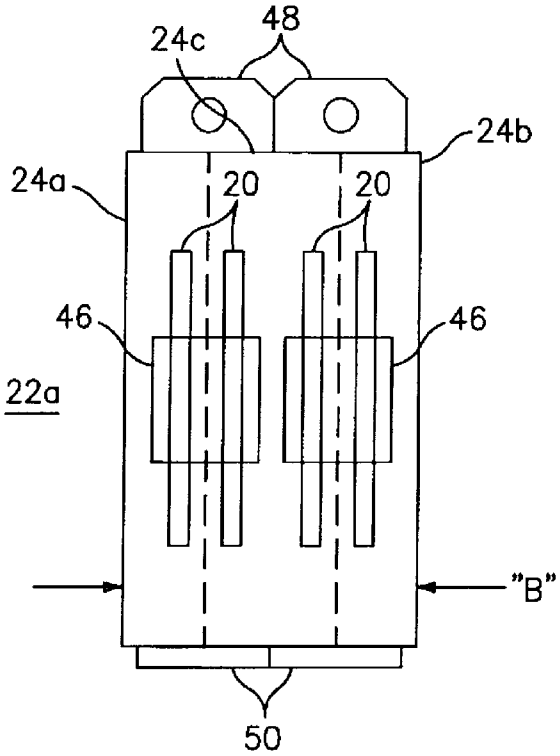
FIG. 7 is a top view of a high ampere rated single pole module similar to that of FIG. 5 except comprising two sets of two rotary contact arm assemblies arranged for parallel connection in accordance with the invention.
Figure 6:
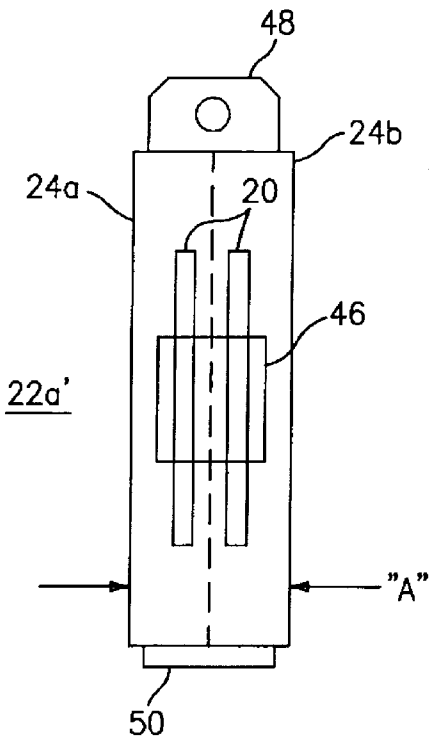
FIG. 6 is a top view of a low ampere rated single pole module similar to that of FIG. 4 except comprising two contact arms in parallel.

FIG. 7 depicts an alternate embodiment of single-pole module 22*a* according to the invention, comprising three current path housings 24*a*, 24*b*, 24*c* contained within two double rotor assemblies 46, each provided with two rotary contact arms 20, connected in parallel to allow a quiescent current higher than that allowed by the prior art single pole module 22*a*' shown in FIG. 6.

Figure 8:
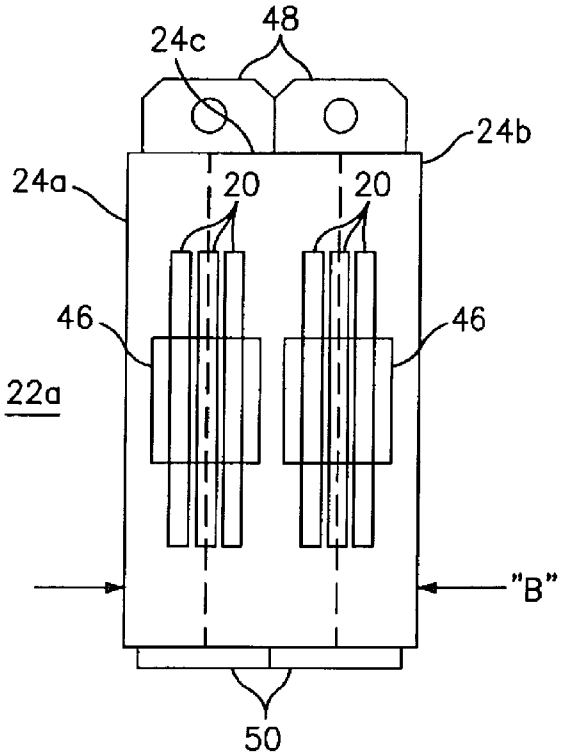
FIG. 8 is a top view of a high ampere rated single pole module similar to that of FIG. 5 except comprising two sets of three rotary contact arm assemblies arranged for parallel connection in accordance with the invention.

FIG. 8 is a further alternate embodiment of a single pole module 22*a* according to the invention, comprising three current path housings 24*a*, 24*b*, 24*c* contained within two triple assemblies 46, each provided with three rotary contact arms 20, connected in parallel to allow a quiescent current higher than that allowed by the single pole module 22*a*' shown in FIG. 6.

In the single pole module 22*a* shown in FIG. 7 and FIG. 8, the combined width of internal and external current path housings (24*a*+24*b*+24*c*) results in dimension "B" being less than two times dimension "A".

What has been described herein depicts just some of the embodiments of the invention, and is not to be considered as limiting its scope and all similar and equivalent approaches. For example, the number of line straps 34 and load straps 36 connected in parallel to the external connection points 48, 50 can more than two, if higher quiescent currents are desired, yet maintaining dimension "B" of the module less than that of the sum of dimensions "A" of an equivalent number of prior art modules connected in parallel. Therefore, in the case of three modules, B<3A.

What is claimed is:

1. A circuit breaker comprising:

a circuit breaker housing;

a current path housing;

a first current path arranged within said current path housing and connected to a protected circuit, said first current path having at least two separable contacts within said circuit breaker housing and arranged for connection with said protected circuit, said first current path at least two contacts being arranged at opposite ends of at least one first current path;

a second current path arranged within said current path housing, electrically connected in parallel to said first current path and connected to said protected circuit, said second current path having at least two of separable contacts within said circuit breaker housing and arranged for connection with said protected circuit, said second current pat at least two contacts being arranged at opposite ends of at least one second current path;

an operating mechanism within said circuit breaker housing arranged for moving said first and second current path in a rotary motion to disconnect said protected circuit upon occurrence of an overcurrent in said protected circuit; and a trip unit within said circuit breaker housing for articulating said operating mechanism for disconnecting said protected circuit upon occurrence of said overcurrent;

a second rotor connecting said second current path with said operating mechanism;

a second line strap, arranged at one end of said second current path, said second line strap having a third stationary contact mounted thereon; and a second load strap, arranged at another end of said second current path, said second line strap having a fourth stationary contact mounted thereon.

* * * * *